US005241351A

United States Patent [19]

Owens

[11] Patent Number: 5,241,351

[45] Date of Patent: Aug. 31, 1993

[54] MULTI-BLADE TURRET HOLDER

[75] Inventor: Alvin J. Owens, Rochester, N.Y.

[73] Assignee: Xerox Corporation, Stamford, Conn.

[21] Appl. No.: 978,547

[22] Filed: Nov. 19, 1992

[51] Int. Cl.[5] ..... G03G 21/00

[52] U.S. Cl. ..... 355/299; 15/256.5

[58] Field of Search ..... 15/256.6, 256.51, 256.52; 355/296, 299; 474/92

[56] References Cited

U.S. PATENT DOCUMENTS

| | | | |
|---|---|---|---|
| 1,239,066 | 9/1917 | Winters | 198/497 |
| 2,698,453 | 1/1955 | Garrow | 15/256.51 |
| 3,854,162 | 12/1974 | Russell | 15/256.51 |
| 4,083,633 | 4/1978 | Shanly | 355/15 |
| 4,202,437 | 5/1980 | Gordon | 15/256.5 X |
| 4,568,175 | 2/1986 | Inowa et al. | 15/256.51 X |
| 4,640,608 | 2/1987 | Higaya et al. | 355/15 |
| 4,989,047 | 1/1991 | Jugle et al. | 355/297 |
| 5,081,505 | 1/1992 | Ziegelmuller et al. | 355/299 |

*Primary Examiner*—A. T. Grimley
*Assistant Examiner*—J. E. Barlow, Jr.
*Attorney, Agent, or Firm*—T. L. Fair

[57] ABSTRACT

A multi-blade holding apparatus that rotates from one blade to the next. The multi-blade holder holds the cleaning blades in place by using clamping inserts to hold the blades in place in the holder. The clamping inserts also allow for alignment and adjustment of the blades according to thickness. Spring loaded pins secure the clamping insert to the core of the multi-blade turret holder.

2 Claims, 4 Drawing Sheets

MULTI-BLADE TURRET HOLDER

BACKGROUND OF THE INVENTION

This invention relates generally to an electrophotographic printing, and more particularly, a multiple blade holder for removing particles adhering to the photoconductive member.

In the process of electrophotographic printing, a photoconductive surface is charged to a substantially uniform potential. The photoconductive surface is imagewise exposed to record an electrostatic latent image corresponding to the informational areas of an original document being reproduced. This records an electrostatic latent image on the photoconductive surface corresponding to the informational areas contained within the original document. Thereafter, a developer material is transported into contact with the electrostatic latent image. Toner particles are attracted from the carrier granules of the developer material onto the latent image. The resultant toner powder image is then transferred from the photoconductive surface to a sheet of support material and permanently affixed thereto.

This process is well known and useful for light lens copying from an original and printing applications from electronically generated or stored originals, and in ionography.

In a reproduction process of the type as described above, it is inevitable that some residual toner will remain on the imaging (i.e. photoreceptive, photoconductive) surface after the toner image has been transferred to the sheet of support material (e.g. paper). It has been found that with such a process that the forces holding some of the toner particles to the imaging surface are stronger than the transfer forces and, therefore, some of the particles remain on the surface after transfer of the toner image. In addition to the residual toner, other particles, such as paper debris (i.e. Kaolin, fibers, clay), additives and plastic, are left behind on the surface after image transfer. (Hereinafter, the term "residual particles" encompasses residual toner and other residual particles remaining after image transfer.) The residual particles adhere firmly to the surface and must be removed prior to the next printing cycle to avoid its interfering with recording a new latent image thereon.

Various methods and apparatus may be used for removing residual particles from the photoconductive imaging surface. hereinbefore, a cleaning brush, a cleaning web, and a cleaning blade have been used. Both cleaning brushes and cleaning webs operate by wiping the surface so as to affect transfer of the residual particles from the imaging surface thereon. After prolonged usage, however, both of these types of cleaning devices become contaminated with toner and must be replaced. This requires discarding the dirty cleaning devices. In high-speed machines this practice has proven not only to be wasteful but also expensive.

The shortcomings of the brush and web made way for another now prevalent form of cleaning known and disclosed in the art—blade cleaning. Blade cleaning involves a blade, normally made of a rubberlike material (i.e. polyurethane) which is dragged or wiped across the surface to remove the residual particles from the surface. Blade cleaning is a highly desirable method, compared to other methods, for removing residual particles due to its simple, inexpensive structure. However, there are certain deficiencies in blade cleaning which are primarily a result of the frictional sealing contact that must occur between the blade and the surface. This frictional sealing contact often leads to blade failure and as a result requires blade replacement.

One problem in the use of such cleaning blade systems for cleaning moving xerographic photoreceptor imaging surfaces of imaging material has been in the mounting or support of the blade, particularly with compressible elastomeric blades. If the blade is compressed, or not completely linearly supported at its mounting edge it may not uniformly engage the imaging surface being repeatedly rotated past the blade edge. This can cause localized cleaning failures causing streaks on the copies, or total cleaning failures as by blade "tuck-under".

The following disclosures may be relevant to various aspects of the present invention and may be briefly summarized as follows:

U.S. Pat. No. 4,989,047 to Jugle et al. discloses an apparatus for cleaning an electrophotographic printer imaging surface. The cleaning apparatus includes a primary cleaner device and a secondary cleaning member. The secondary cleaning apparatus consists of a blade holder pivotally connected to the housing that holds a cleaning blade in frictional contact with the imaging surface.

U.S. Pat. No. 4,640,608 to Higaya et al. discloses an apparatus for cleaning a photoconductive surface. The cleaning apparatus includes a blade holder that detachably holds a cleaning blade between two members that are fastened together.

U.S. Pat. No. 4,083,633 to Shanly discloses a blade cleaning holder. One edge of a blade mounted within a blade retaining channel with opposing generally parallel walls spaced apart by a distance slightly greater than the thickness of the blade to provide unobstructed ingress of the cleaning blade mounting edge against a linear base of the channel without compression of the blade. The blade mounting channel has an arcuate intermediate bend resiliently bending the cleaning blade with the channel sufficiently to cause the cleaning blade to resiliently frictionally engage both walls of the channel to frictionally retain the blade and to seal the channel from the image developer material.

U.S. Pat. No. 3,854,162 to Russell discloses a doctor blade holder having a pair of holder members which retain the back edge of a doctor blade between them. One member exerts resilient pressure on the blade to urge it toward the other member through a resilient yieldable strip mounted thereon, the arrangement providing desirable flexibility for the blade and also providing sealing.

SUMMARY OF INVENTION

Briefly stated, and in accordance with one aspect of the present invention, there is provided a cleaning apparatus including a plurality of cleaning members. Means for holding a selected variable number of the plurality of cleaning members, the holding means being movable to position one of the plurality of cleaning members in an operative position with the remainder of the plurality of cleaning members being spaced therefrom. And, means for releasably and adjustably securing the plurality of cleaning members to the holding means.

Pursuant to another aspect of the present invention, there is provided an electrophotographic printing machine of the type having residual material adhering to a photoconductive member after transferring a developed image from the photoconductive member to a sheet, wherein the improved cleaning apparatus used therein comprises a plurality of cleaning members. Means for holding a selected variable number of the plurality of cleaning members, the holding means being movable to position one of the plurality of cleaning members in an operative position with the remainder of the plurality of cleaning members being spaced therefrom. And, means for releasably and adjustably securing the plurality of cleaning members to the holding means.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 5:
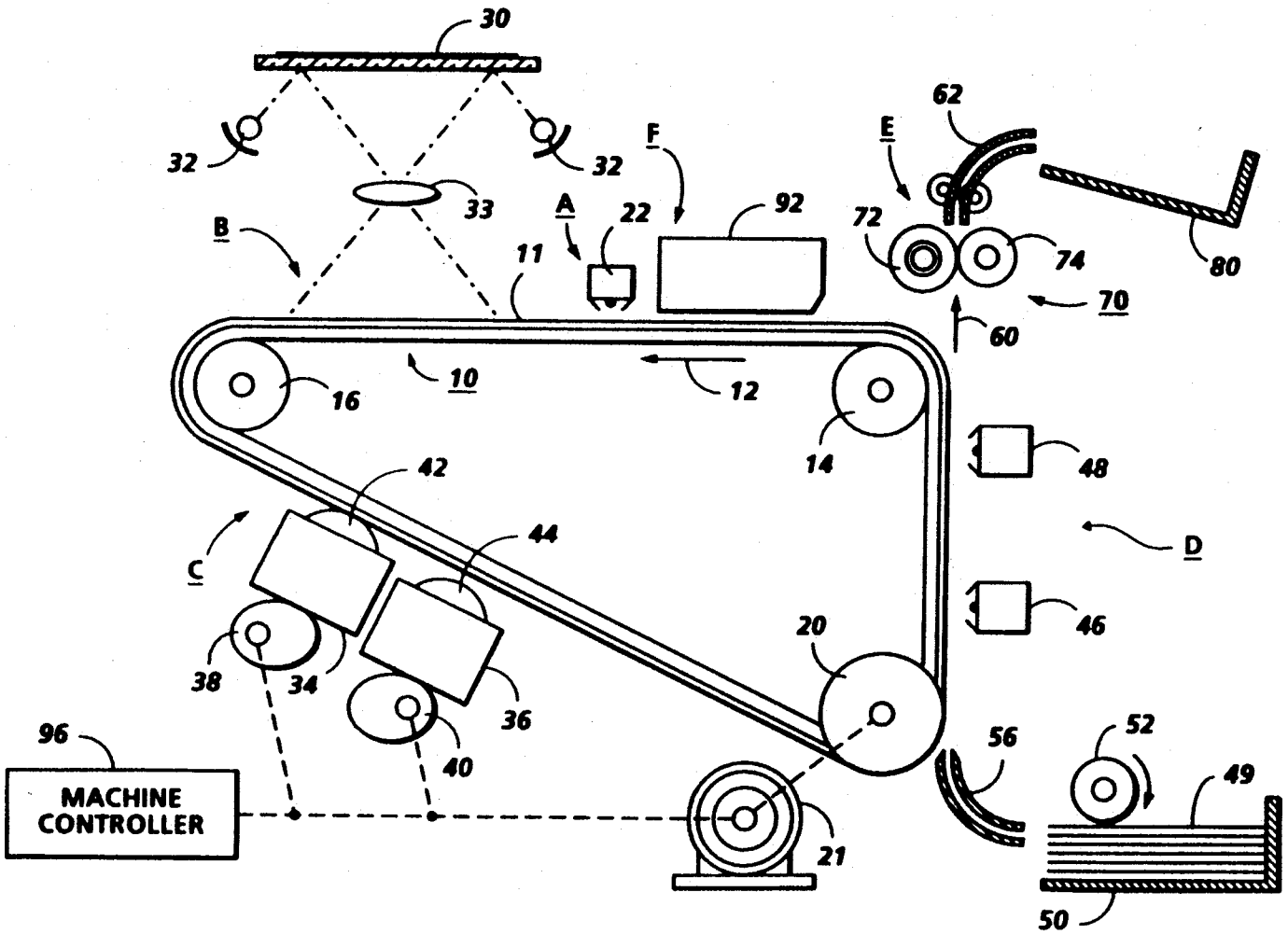
FIG. 5 is a schematic illustration of a printing apparatus incorporating the inventive features of the present invention therein.

For a general understanding of an electrophotographic printer or copier in which the present invention may be incorporated, reference is made to FIG. 5 which depicts schematically the various components thereof. Hereinafter, like reference numerals will be employed throughout to designate identical elements. Although the multiple blade holder apparatus of the present invention is particularly well adapted for use in an electrophotographic printing machine, it should become evident from the following discussion, that it is equally well suited for use in other applications and is not necessarily limited to the particular embodiments shown herein.

Referring now to the drawings, the various processing stations employed in the reproduction machine illustrated in FIG. 5 will be described briefly hereinafter. It will no doubt be appreciated that the various processing elements also find advantageous use in electrophotographic printing applications from an electronically stored original, and with appropriate modifications, to an ion projection device which deposits ions in image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance successive portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers which rotate freely as the belt 10 moves in the direction of arrow 12.

With continued reference to FIG. 5, initially a portion of the belt 10 passes through charging station A. At charging station A, a corona device 22 charges a portion of the photoreceptor belt 10 to a relatively high, substantially uniform potential, either positive or negative.

At exposure station B, an original document is positioned face down on a transparent platen 30 for illumination with flash lamps 32. Light rays reflected from the original document are reflected through a lens 33 and projected onto the charged portion of the photoreceptor belt 10 to selectively dissipate the charge thereon. This records an electrostatic latent image on the belt which corresponds to the informational area contained within the original document. Alternatively, a laser may be provided to imagewise discharge the photoreceptor in accordance with stored electronic information.

Thereafter, the belt 10 advances the electrostatic latent image to development station C. At development station C, one of at least two developer housings 34 and 36 is brought into contact with the belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed latent image to transfer station D. At transfer station D, a sheet of support material such as paper copy sheets is advanced into contact with the developed latent images on the belt 10. A corona generating device 46 charges the copy sheet to the proper potential so that it becomes tacked to the photoreceptor belt 10 and the toner powder image is attracted from the photoreceptor belt 10 to the sheet. After transfer, a corona generator 48 charges the copy sheet to an opposite polarity to detack the copy sheet from the belt 10, whereupon the sheet is stripped from the belt 10 at stripping roller 14.

Sheets of support material 49 are advanced to transfer station D from a supply tray 50. Sheets are fed from tray 50 with sheet feeder 52, and advanced to transfer station D along conveyor 56.

After transfer, the sheet continues to move in the direction of arrow 60 to fusing station E. Fusing station E includes a fuser assembly, indicated generally by the reference numeral 70, which permanently affixes the transferred toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a shoot 62 to an output 80 or finisher.

Residual particles, remaining on the photoreceptor belt 10 after each copy is made, may be removed at cleaning station F. The cleaning apparatus of the present invention is represented by the reference numeral 92. (See FIGS. 1 to 4 for more detailed views of the present invention.) Removed residual particles may also be stored for disposal.

A machine controller 96 is preferably a known programmable controller or combination of controllers, which conventionally control all the machine steps and functions described above. The controller 96 is responsive to a variety of sensing devices to enhance control of the machine, and also provides connection of diagnostic operations to a user interface (not shown) where required.

As thus described, a reproduction machine in accordance with the present invention may be any of several well known devices. Variations may be expected in specific electrophotographic processing, paper handling and control arrangements without affecting the present invention. However, it is believed that the foregoing description is sufficient for purposes of the present application to illustrate the general operation of an electrophotographic printing machine which exemplifies one type of apparatus employing the present invention therein. Reference is now made to FIGS. 1 through 4 where the showings are for the purpose of illustrating a preferred embodiment of the invention and not for limiting the same.

Figure 1:
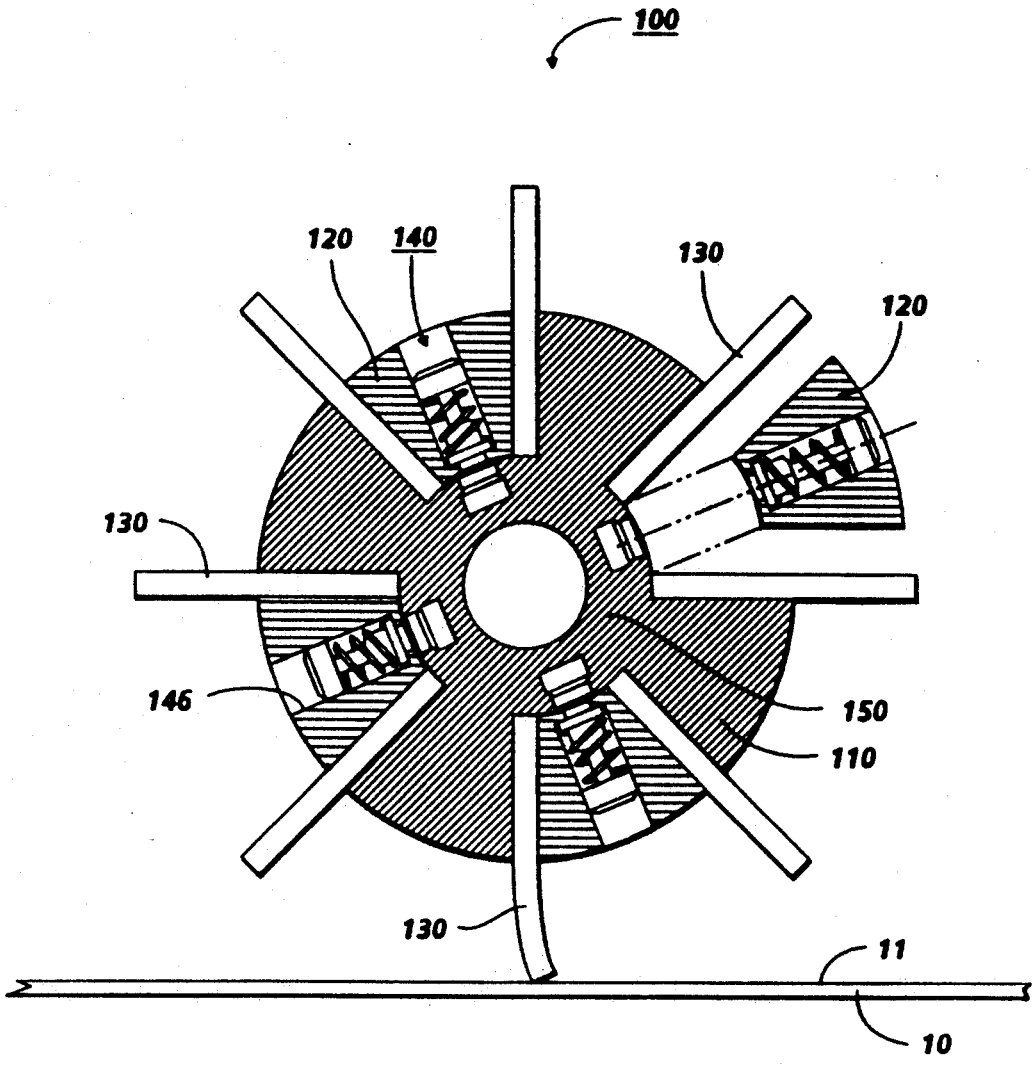
FIG. 1 is an elevational view of the cleaning apparatus of the present invention.

Referring now to FIG. 1, which shows an elevational view of a turret (i.e. rotatable) multi-blade holder. The turret multi-blade holder 100 consists of a holder core that is rotatable counterclockwise or clockwise depending upon the architecture of the printing machine. The holder core consists of a center portion 150 with shaft-like extrusions 110 extending outwardly therefrom. The shaft-like extrusions 110 allow the cleaning blades 130 (e.g. urethane blades) that are inserted into the holder to rest against either side of these extrusions 110 until the blades 130 are held in place by the clamping inserts 120. The clamping inserts 120 allow adjustment and alignment of the cleaning blades 130 (ranging in thickness from about 0.80 inches to about 0.150 inches) to the proper blade holder angle for cleaning the imaging surface. The clamping inserts 120 are secured in place by spring loaded pins 140 through a channel 146 through the clamping insert 120 to the center portion 150 of the holder core. One blade 130 at a time is rotated into frictional contact with the imaging surface 11 of the photoreceptor belt 10.

Figure 2:
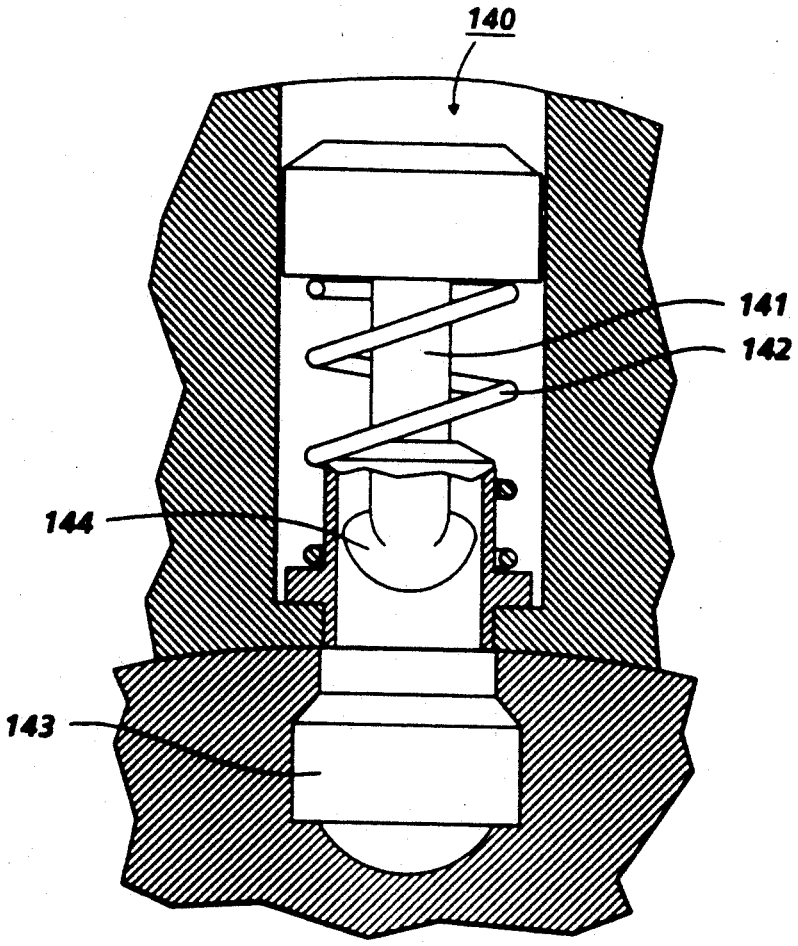
FIG. 2 is an elevational view of the spring loaded pin.

Referring now to FIG. 2 which shows an elevational view of the spring loaded pin 140. The clamping insert (see 120 of FIG. 1) is held in place by pushing the spring loaded pin 140 into a receptacle 143 located in the center portion of the holder core, causing the spring 142, around the pin 140, to depress. The pin 141 is rotated approximately ¼ turn to secure the pin locking head 144 into the receptacle 143.

Figure 3:
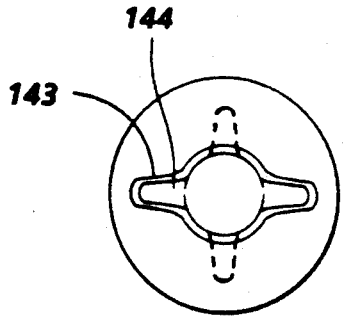
FIG. 3 is a top view of the receptacle in the holder core for locking in the spring loaded pin.

Referring now to FIG. 3, which shows a top view of the receptacle 143. The receptacle 143 locks the spring loaded pin 140 (see FIG. 2) in place when the locking head 144 (see phantom lines) is rotated ¼ turn. To release the spring loaded pin 140 (see FIG. 2), the spring loaded pin is rotated ¼ turn which releases the depressed spring, causing the spring loaded pin to expand. The expanding spring then releases the clamping insert from the holder core.

Figure 4:
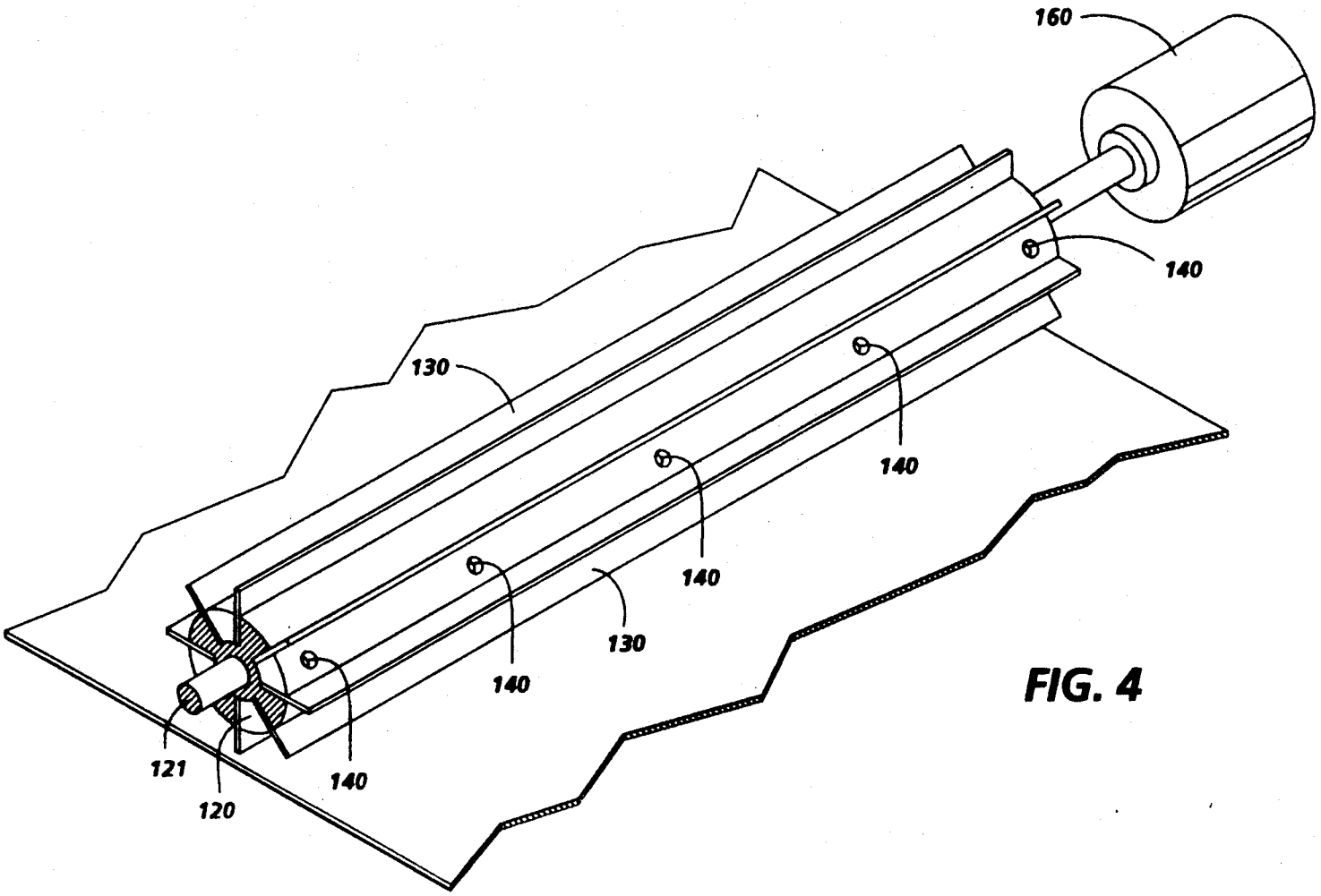
FIG. 4 is a perspective view of the FIG. 1 cleaning apparatus.

Referring now to FIG. 4 which shows a perspective view of the turret multi-blade holder shown in FIG. 1. This view shows that the clamping inserts 120 extend the length of the cleaning blades 130 and are held in place by spring loaded pins 140. (It is noted that the blade holder can be made from a number of materials in a variety of ways, e.g. from aluminum by extrusion.) A shaft 121 is connected to the holder core on one end and a motor 160 on the opposite end. The shaft 121, powered by the motor 160, rotates the holder core to remove one blade and position another blade 130 into contact with the imaging surface.

In recapitulation, the apparatus for providing a turret multi-blade holder requires a blade holder core, clamping inserts and spring loaded pins. The multi-blade holder holds the cleaning blades in place by compressing the blades between the clamping inserts and the holder core. The clamping inserts enable alignment and adjustment of the blades within the holder of varying thickness. Spring loaded pins are placed along the length of the clamping inserts to secure the blades and clamping inserts into place.

It is, therefore, apparent that there has been provided in accordance with the present invention, a rotatable multi-blade holder that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A cleaning apparatus, comprising:

a plurality of cleaning members;

means for holding a selected variable number of said plurality of cleaning members, said holding means being movable to position one of said plurality of cleaning members in an operative position with the remainder of said plurality of cleaning members being spaced therefrom, said holding means having a core, said core including a central portion and a plurality of shaft extrusions extending outwardly therefrom with said shaft extrusions being spaced from one another, said cleaning members including a blade mounted in the space between adjacent ones of said plurality of shaft extrusions, and means for releasably and adjustably securing said plurality of cleaning members to said core, said securing means comprises a clamping insert, mounted in the space between adjacent ones of said plurality of shaft extrusions with said blade interposed therebetween, said clamping insert including a member defining an aperture therein, said member being interfit in the space between adjacent ones of said plurality of shaft extrusions and a pin having a portion thereof passing through the aperture in said member to secure said member to said core and means for resiliently urging said pin into engagement with said core.

2. An electrophotographic printing machine of the type having residual material adhering to a photoconductive member after transferring a developed image from the photoconductive member to a sheet, wherein the improved cleaning apparatus used therein comprises:

a plurality of cleaning members;

means for holding a selected variable number of said plurality of cleaning members, said holding means being movable to position one of said plurality of cleaning members in an operative position with the remainder of said plurality of cleaning members being spaced therefrom, said holding means having a core, said core including a central portion and a plurality of shaft extrusions extending outwardly therefrom with said shaft extrusions being spaced from one another, said cleaning members including a blade mounted in the space between adjacent ones of said plurality of shaft extrusions, and means for releasably and adjustably securing said plurality of cleaning members to said core, said securing means includes a clamping insert mounted in the space between adjacent ones of said plurality of shaft extrusions with said blade interposed therebetween, said clamping insert including a member defining an aperture therein, said member being interfit in the space between adjacent ones of said plurality of shaft extrusions and a pin having a portion thereof passing through the aperture in said member to secure said member to said core and means for resiliently urging said pin into engagement with said core.

* * * * *